US005133404A

United States Patent [19]

Dollison

[11] Patent Number: 5,133,404

[45] Date of Patent: Jul. 28, 1992

[54] ROTARY RUNNING TOOL FOR ROTARY LOCK MANDREL

[75] Inventor: William W. Dollison, Dallas, Tex.

[73] Assignee: Otis Engineering Corporation, Dallas, Tex.

[21] Appl. No.: 755,770

[22] Filed: Sep. 6, 1991

Related U.S. Application Data

[62] Division of Ser. No. 557,668, Jul. 25, 1990, Pat. No. 5,082,061.

[51] Int. Cl.[5] ..... E21B 23/02

[52] U.S. Cl. ..... 166/72; 166/115; 166/125; 166/237; 166/240

[58] Field of Search ..... 166/386, 72, 73, 117.7, 166/240, 237, 117, 125, 123, 124, 178, 115; 175/295, 296

[56] References Cited

U.S. PATENT DOCUMENTS

| | | | |
|---|---|---|---|
| 1,487,721 | 3/1924 | Clayton | 166/240 X |
| 2,344,121 | 3/1944 | Bassinger | 166/237 X |
| 2,673,614 | 3/1954 | Miller | 166/214 |
| 3,036,641 | 5/1962 | Nutter et al. | 166/240 X |
| 3,208,531 | 9/1965 | Tamplen | 166/125 |
| 3,912,014 | 10/1975 | Wetzel | 166/240 X |
| 4,745,973 | 5/1988 | Semar | 166/237 X |
| 4,781,250 | 11/1988 | McCormick et al. | 166/240 |
| 5,029,642 | 7/1991 | Crawford | 166/72 |

*Primary Examiner*—Hoang C. Dang
*Attorney, Agent, or Firm*—Roland O. Cox

[57] ABSTRACT

A locking system utilizing metal seals for sealing and a rotary lock mandrel which is rotated to lock by a rotary running tool in a landing nipple in a well conduit. The lock mandrel has a metal sealing surface sealingly engageable with a metal seat in the landing nipple and orientors on a number of helically profiled segments which are rotatably engageable with mating profiled segments in the landing nipple. As the lock mandrel is lowered on the running tool into the landing nipple, lock mandrel segments are oriented between nipple segments, and the mandrel metal sealing surface engages the metal seat in the landing nipple. Downward jarring on the running tool rotates the mandrel segments into engagement with the landing nipple segments, locking the lock mandrel in the landing nipple, sealingly engaging the metal seal surface on the metal seat and releasing the running tool from the locking mandrel for retrieval from the well conduit.

10 Claims, 3 Drawing Sheets

ROTARY RUNNING TOOL FOR ROTARY LOCK MANDREL

This application is a division of my co-pending application for U.S. patent, Ser. No. 07/557,668, filed Jul. 25, 1990.

BACKGROUND (1) Technical Field:

This invention pertains to locking systems useful to releasably position well flow control devices in a flow conduit in a well. The present invention particularly pertains to a lock mandrel carrying a flow control, which is oriented on lowering into a compatible landing nipple and rotated by the running tool to seal metal to metal and lock in the landing nipple.

(2) Background Information

Significant and very commercially successful prior locking systems are disclosed in U.S. Pat. Nos. 2,673,614 to Ira A. Miller and 3,208,531 to Jack W. Tamplen. In both prior systems, the running tool moves the lock mandrel downwardly into sealing and locking engagement with a compatible landing nipple in a well flow conduit. Both prior systems utilized resilient material for sealing which often deteriorates rapidly in high temperature and pressure environments in deep well conduits.

SUMMARY OF THE INVENTION

The locking system of this invention includes a landing nipple connectible in a well conduit. The landing nipple has an internal metal seat and helically profiled segments with upper orienting surfaces. A well flow control device is connected to a rotary lock mandrel, which is connected to a rotary running tool and lowered into the well conduit and landing nipple. The rotary lock mandrel has a metal sealing surface and helically profiled segments with lower orienting surfaces. As the lock mandrel moves downwardly in the landing nipple, the lock mandrel orienting surfaces engage the landing nipple orienting surfaces, orienting the lock mandrel segments to be moved downwardly between the landing nipple segments until the lock mandrel metal sealing surface engages the landing nipple metal seat. Repeated downward impact on the running tool operates the running tool to rotate the rotary lock mandrel and segments into locking engagement with the landing nipple segments, sealingly engaging the lock mandrel metal seal surface with the landing nipple metal seat and disconnecting the running tool from the lock mandrel. The lock mandrel may be unlocked for retrieval from the landing nipple by engaging and moving a releasably positioned support holding the lock mandrel segments in expanded position to a position permitting the segments to be moved to a retracted position.

A principal object of this invention is to provide a locking system wherein the landing nipple and lock mandrel have metal seals and the lock mandrel is rotated by the running tool into sealed and locked engagement with the landing nipple and the lock mandrel may be unlocked from the landing nipple by upward pull.

An object of this invention is to provide a rotary lock mandrel having helically profiled segments with orienting surfaces which engage orienting surfaces on helically profiled segments in a compatible landing nipple and orient the lock mandrel segments to move down between the segments in the landing nipple to a position for rotation into locking engagement with the landing nipple.

An object of this invention is to provide a rotary locking mandrel which provides for transmission of the downward force resulting from rotating the lock mandrel to lock in the landing nipple to sealingly engage the lock mandrel in the landing nipple.

Another object of this invention is to provide a rotary lock mandrel having a lower body with a metal seal surface which is swivellably connected to the lock mandrel.

Also an object of this invention is to provide a rotary running tool, which is operated by jar impact after connection to a rotary lock mandrel to rotate the lock mandrel into sealing and locking engagement in a compatible landing nipple and release from the lock mandrel.

BEST MODE FOR CARRYING OUT THE INVENTION

Figure 1:
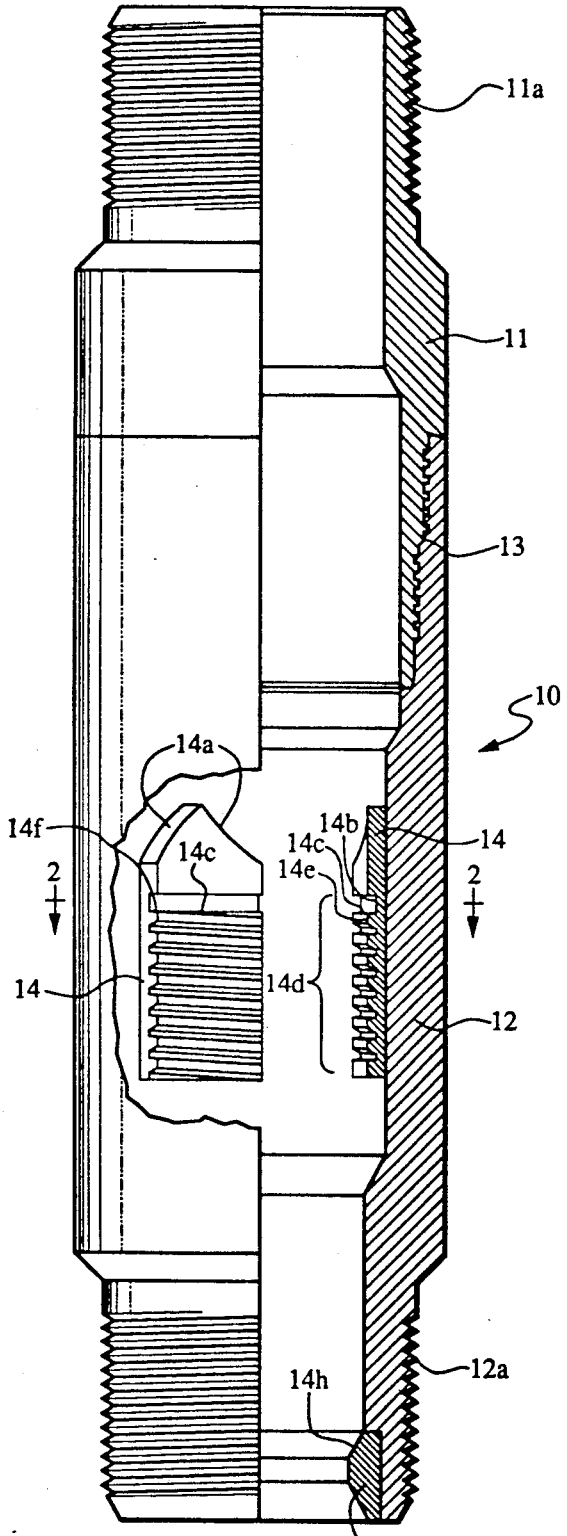
FIG. 1 is a sectioned drawing in elevation showing the landing nipple useful in the system of this invention.
Figure 2:
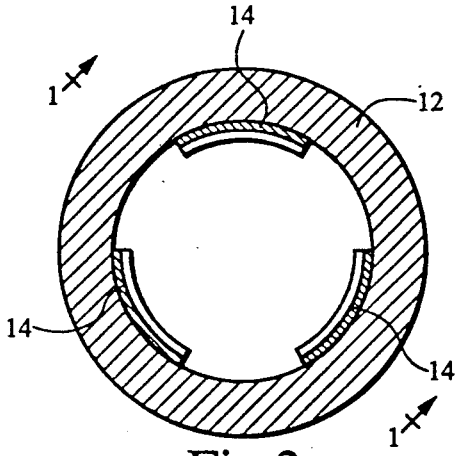
FIG. 2 is a cross sectional drawing along cutting plane line 2—2 of FIG. 1, showing the arrangement of segments in the landing nipple.

FIG. 1 shows a landing nipple 10 having an upper body 11 and a lower body 12 which are connected together with a sealing thread 13. The upper and lower bodies have means 11*a* and 12*a* for connection into a well flow conduit. A number of helically profiled segments 14 are positioned as shown 120° apart in lower body 12 (see also FIG. 2). A thread profile is shown on each segment, but any helical profile could be used. Each segment is 60° wide and has camming surfaces 14*a*, a groove 14*b*, which has a lower side 14*c* and a helically profiled section 14*d*, which has a bore 14*e*. The lower groove sides 14*c* are in the same horizontal plane. On each segment, the same helix and same profile is cut starting from the point of intersection 14f (for a right hand helix) of the lower groove side 14c and the bore 14d at the edge of each segment. An insert 14g having a sealing surface 14h is connected in the lower end of lower body 12 by welding or brazing.

Figure 3:
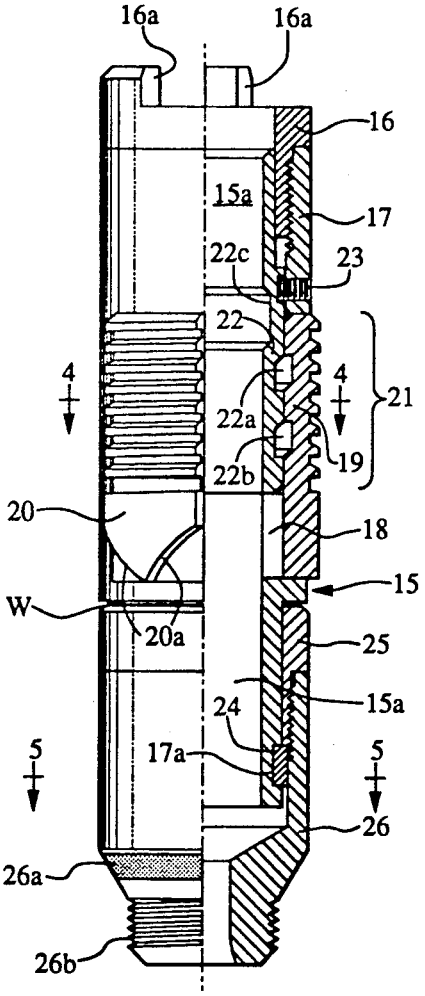
FIG. 3 is a sectioned drawing in elevation showing the rotary lock mandrel utilized in the invention system.

FIG. 3 shows a rotary lock mandrel 15 having a longitudinal flow passage 15a and a half clutch driven member 16 on its upper end. The driven member has a number of slots 16a and is connected in segment mandrel 17, which has a number of window like openings 18. Mounted on each opening is a radially moveable circular segment 19 having an orientor 20 with camming surfaces 20a and a helically profiled section 21. The upper ends of circular segments 19 are in the same horizontal plane and the same helix and same profile is cut on each profiled section 21 so as to rotatively engage the segments 14 of landing nipple 12 when the upper ends of segments 19 are positioned in the same horizontal plane with the lower side 14c of grooves 14b in landing nipple segments 14.

Figure 4:
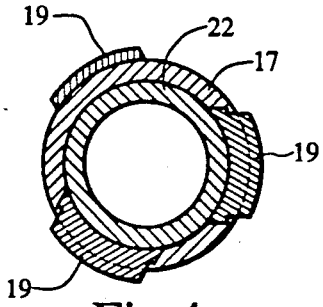
FIG. 4 is a drawing in cross section of the lock mandrel, along line 4—4 of FIG. 3, through the lock mandrel segments and segment support.

Slidably mounted in mandrel 17 is a support 22 which is releasably positioned in the mandrel by shearable member 23 while holding segments 19 in the expanded position—see also FIG. 4. The support has external recesses 22a and 22b and an internal groove 22c.

Figure 5:
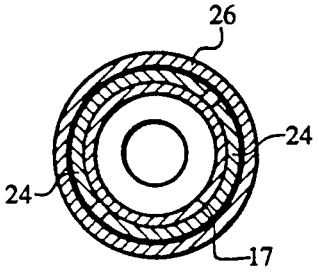
FIG. 5 shows a cross sectional view of the lock mandrel, along line 5—5 of FIG. 3, through the swivel connection in the lock mandrel.

A groove 17a around lower mandrel 17 houses a split ring 24 which swivellably connects a body connector 25 on the key mandrel —see also FIG. 5. Captured between a shoulder on the mandrel and the upper end of the body connector is a belleville spring washer W which is useful to transmit downward force from the key mandrel to connector 25 and into body 26 connected to 25. Body 26 has metal sealing surface 26a and a connection 26b for attachment of a well flow control.

Figure 6:
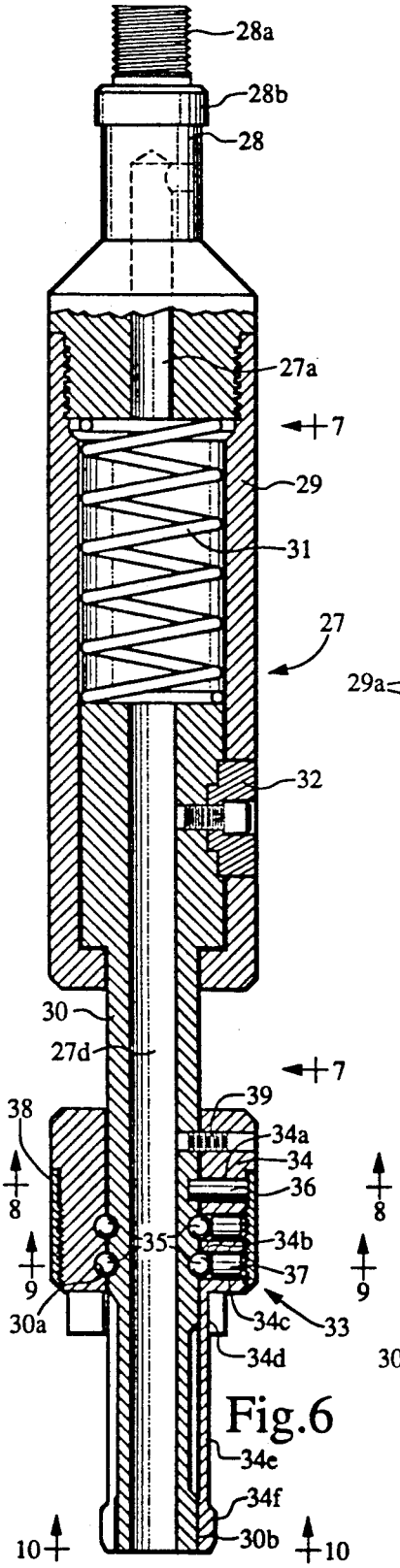
FIG. 6 is an almost completely sectioned drawing in elevation of the rotary running tool useful in the invention system.
Figure 7:
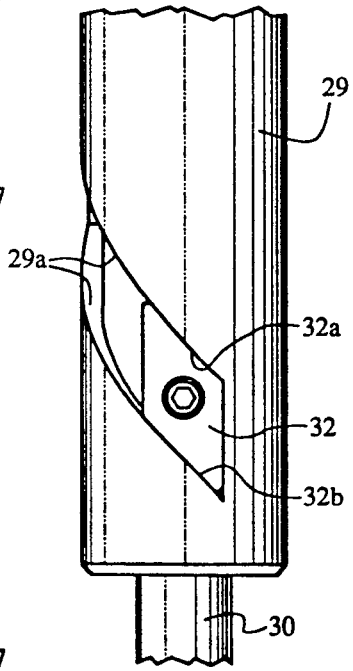
FIG. 7 is an elevational view from line 7—7 of a portion of the rotary running tool of FIG. 6.

The rotary running tool 27 of FIG. 6 has a flow passage 27a and connector 28 connected to a housing 29. The connector has a connection 28a for connecting tool 27 to a well servicing tool string and a fishing flange 28b. Slidably mounted in the housing is an anvil 30 and a spring 31 biasing the anvil downwardly. As shown in FIG. 7, a helical slot 29a has been cut in the housing and a lug 32, with camming surfaces 32a and 32b, has been slidably mounted in the slot and connected to the anvil.

Figure 8:
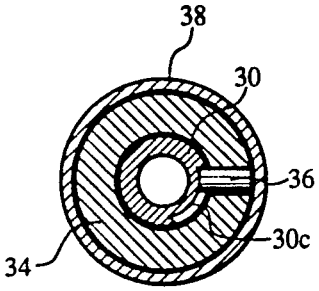
FIG. 8 is a drawing of a cross section along line 8—8 of FIG. 6 showing the pin which limits rotation of the anvil in the running tool connector.
Figure 10:
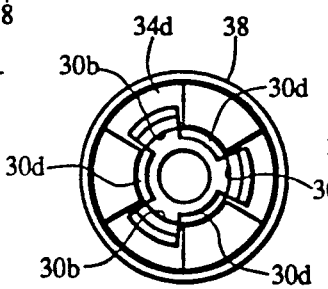
FIG. 10 a view along line 10—10 of the lower end of the running tool of FIG. 6 with the anvil in lugs expanded position.

Mounted around and cooperable with the lower anvil is a rotary connector assembly 33, useful to connect running tool 27 to rotary lock mandrel 15. The lower anvil has been provided with at least one groove around 30a, which is semi-circular in cross-section and a number of support surfaces 30b also shown in FIGS. 10 and 11. A slot 30c (see FIG. 8) is provided around the anvil and axial grooves 30d are provided between support surfaces 30b (FIGS. 10 and 11) into which lugs 34f may be retracted.

Connector assembly 33 includes a collet 34 having a hole 34a, at least one internal groove 34b, which is semi-circular in cross-section, a lower hole 34c, a half clutch driving skirt 34d with a number of slots and a number of fingers 34e, each finger having a lug 34f, which is engageable with an anvil support surface 30b.

Figure 9:
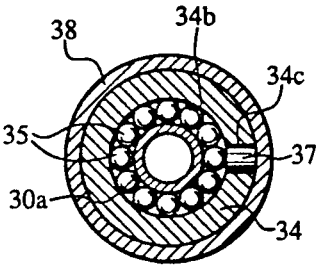
FIG. 9 is a cross sectional drawing taken along line 9—9 of FIG. 6 showing the rotational connection between the running tool anvil and connector.

To position the collet for limited rotation around and connect it on the anvil, a number of balls 35 have been introduced through collet hole 34c into grooves 30a and 34b—see also FIG. 9. A pin 36 has been installed in hole 34a and extends into anvil slot 30c. Slot 30c limits rotation of the pin and collet to 60° around the anvil between lugs expanded position where lugs 34f engage support surfaces 30b and lugs retractable position where surfaces 30b are between lugs 34f. Pin 36 and a plug 37 in hole 34c are retained by a cover 38 connected on the collet. A shearable member 39 threaded through the collet into a hole in the anvil, releasably positions anvil support surfaces 30b under lugs 34f, holding the lugs in expanded position.

To utilize the rotary lock system of this invention, a flow control device to be installed in landing nipple 10 in a well flow conduit is connected on rotary lock mandrel 15. Rotary running tool 27 is connected on a string of well servicing tools which include a jar and in the lock mandrel support groove 22c by removing shearable member 39, turning collet 34 on anvil 30 to position support surfaces 30b between lugs 34f and inserting the running tool collet into passage 15a in rotary lock mandrel 15. After running tool driving skirt 34d engages driven member 16 and collet lugs 34f expand into support groove 22c, connector assembly 33 is rotated on anvil 30 positioning surfaces 30b under lugs 34f to hold the lugs expanded in the support groove connecting the rotary running tool to the rotary lock mandrel and member 39 is replaced.

The running tool and lock mandrel are now lowered into the well conduit and on entry into the landing nipple, lock mandrel orientor camming surfaces 20a engage landing nipple segment camming surfaces 14a and turn the lock mandrel so the lock mandrel segments 19 can be moved down between landing nipple segments 14 until metal seal surface 26a on lock mandrel body 26 engages landing nipple metal sealing surface 14h. Unflexed washer W positions segments 19 to be rotated into engagement with segments 14.

Now application of downward jar impact on rotary running tool 27 moves housing 29 downwardly on anvil 30, compressing spring 31, engaging helical slot 29a with lug camming surface 32a and applying torque to the anvil. Repeated application of downward impact on the running tool rotates the lock mandrel segments 19 into engagement with landing nipple segments 14 through running tool driving skirt 34d and lock mandrel driven member 16. As segments 19 are rotated into segments 14, downward force acting on the segment mandrel 17 is transmitted through flexed washer W, connector 25 and into body 26 to sealingly engage metal sealing surface 26a with landing nipple sealing surface 14h on insert 14g. When the lock mandrel is rotated to engage the landing nipple, metal sealing surface 26a does not rotate on sealing surface 14h as body 26 may swivel or rotate on segment mandrel 17. Lock mandrel 15 is now locked in sealing engagement in landing nipple 10 with support 22 positioning segments 19 in expanded position.

Figure 11:
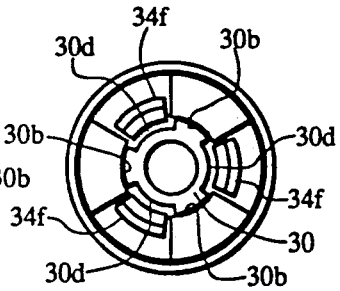
FIG. 11 is also a view along line 10—10 of the lower end of the running tool of FIG. 6 showing the anvil rotated to lugs retractable position.
Figure 12:
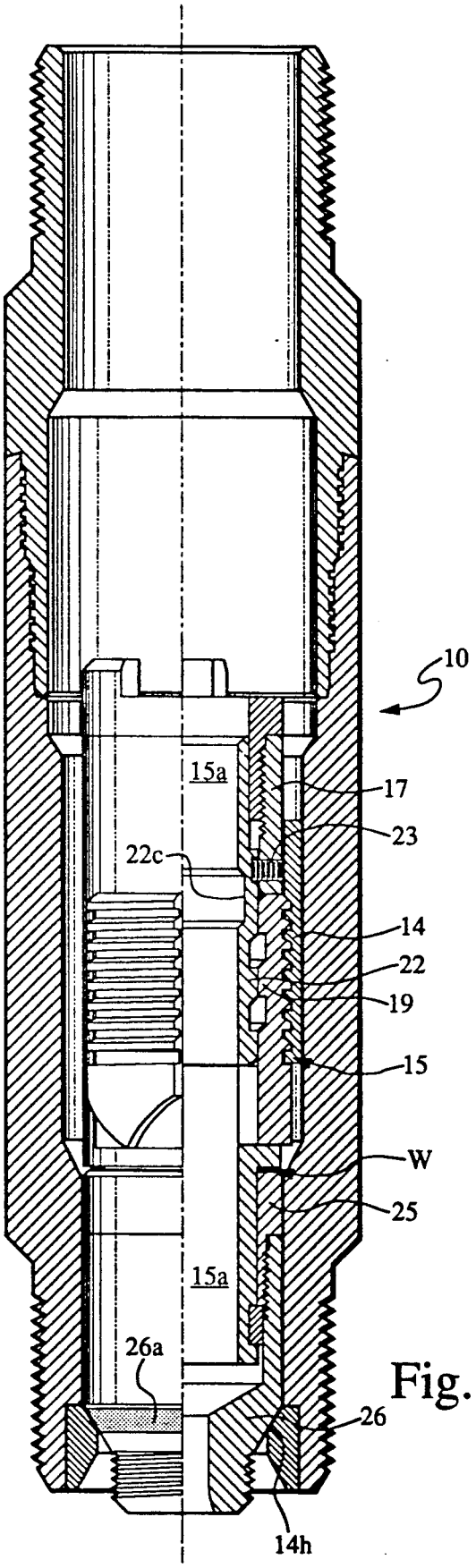
FIG. 12 is a partially sectioned drawing in elevation showing the rotary lock mandrel sealingly engaged and locked in the landing nipple of the present invention.

Continued downward impact on the running tool will disconnect the running tool from the lock mandrel by shearing member 39 and rotating the anvil 60°, positioning anvil grooves 30d under lugs 34f as shown in FIG. 11. Raising running tool 27 will cam in and retract lugs 34f into grooves 30d from support groove 22c, permitting the running tool to be retrieved from the well conduit back to surface. Two-way flow may now occur through the flow control and mandrel flow passage 15a (see FIG. 12).

When it is desirable to retrieve the flow control and lock mandrel 15 from landing nipple 10, a conventional pulling tool is connected to well servicing tools including a jar, lowered into the well conduit and the pulling tool is operated to connect into groove 22c in the lock mandrel support. Upward impact forces delivered to the pulling tool by the jar will shear lock mandrel shearable member 23 and move support 22 upwardly until the mandrel segments 19 are cammed into support recesses 22*a* and 22*b* by nipple segments 14 and into retracted position. The lock mandrel and flow control may now be retrieved from the landing nipple and flow conduit.

I claim:

1. A running tool for a rotary lock mandrel comprising:

(a) a housing having a connection on the end thereof;

(b) an anvil slidably mounted in said housing and extending from the other end of said housing;

(c) means in said housing for rotating said anvil relative to said housing including:

a helical slot in said housing, a lug slidably mounted in said helical slot and attached to said anvil and a spring biasing said anvil to extend from said housing; and (d) means on said extending anvil for rotatively and releasably connecting said running tool to a rotary lock mandrel.

2. The running tool of claim 1 wherein the means on the anvil for connecting the running tool to a rotary lock mandrel comprises:

(a) alternate support surfaces and axial grooves equally spaced around the extended end of the anvil;

(b) a collet having a finger for each said axial groove, each finger having a lug narrower than said grooves;

(c) means for positioning said collet on said anvil for rotation around said anvil;

(d) means for releasably connecting said collet on said anvil in lugs expanded position and on release to permit rotation of said anvil in said collet to align said collet finger lugs with said axial grooves for movement of said lugs to retracted position; and (e) means on said collet for rotatively engaging a rotary lock mandrel.

3. The running tool of claim 2 wherein the means for releasably connecting said collet on said anvil is a shearable pin passing through the collet into the anvil.

4. The running tool of claim 2 further including means limiting angular rotation of the anvil in the collet.

5. The running tool of claim 4 wherein the means limiting rotation includes a pin through the collet extending into a groove in the anvil, said groove limiting the angle of rotation of said anvil in said collet to the desired angle.

6. The running tool of claim 5 wherein the desired angle of rotation is 60° for three equally spaced axial anvil grooves and collet fingers.

7. The running tool of claim 2 wherein the means for positioning the collet for rotation around the anvil comprise:

(a) a groove around the anvil;

(b) an internal groove in the collet; and (c) a number of balls retained in said anvil and collet grooves.

8. The running tool of claim 2 wherein the means on the collet for rotatively engaging a rotary lock mandrel is a driving skirt having slots therethrough.

9. A running tool for a rotary lock mandrel comprising:

(a) a housing having a connection on the upper end thereof;

(b) an anvil slidably mounted in said housing and extending from the other end of said housing;

(c) means in said housing for rotating said anvil relative to said housing, said means including:

a helical slot in said housing, a lug slidably mounted in said helical slot and attached to said anvil, and a spring biasing said anvil to extend from said housing; and (d) means on said anvil for rotatively and releasably connecting said running tool to a rotary lock mandrel including:

alternate support surfaces and axial grooves spaced around the extended end of said anvil, said anvil having a groove therearound, a collet having a finger for each said axial groove, each finger having a lug, said collet having an internal groove therein and a driving skirt with slots therethrough, a number of balls retained in said groove around the anvil and said internal groove in the collet, a shearable pin passing through said collet and said anvil for releasably connecting said collet on said anvil in lugs expanded position and on release to permit rotation of said anvil in said collet to align said collet finger lugs with said axial grooves for movement of said lugs to retracted position.

10. The running tool of claim 9 further including a pin through the collet extending into a groove of less than 360° around the anvil for limiting angular rotation of said anvil in said collet.

* * * * *